US005997336A

United States Patent [19]

Yamamoto et al.

[11] Patent Number: 5,997,336

[45] Date of Patent: Dec. 7, 1999

[54] INSULATION DISPLACEMENT TERMINAL

[75] Inventors: Takao Yamamoto, Asaka; Yasushi Saitoh, Nagoya, both of Japan

[73] Assignees: Sumitomo Wiring Systems Ltd.; Harness System Technologies Research, Ltd.; Sumitomo Electric Industries, Ltd.; Honda Giken Kogyo K.K., all of Japan

[21] Appl. No.: 09/021,354

[22] Filed: Feb. 10, 1998

[30] Foreign Application Priority Data

Feb. 13, 1997 [JP] Japan ..... 9-029383

[51] Int. Cl.[6] ..... H01R 4/24

[52] U.S. Cl. ..... 439/397

[58] Field of Search ..... 439/395–400, 439/406, 407

[56] References Cited

U.S. PATENT DOCUMENTS 5,030,132 7/1991 Hayes et al. ..... 439/397

FOREIGN PATENT DOCUMENTS 0101290 2/1984 European Pat. Off. .
2621423 4/1989 France ..... 439/400
4028987 3/1992 Germany .
4108133 9/1992 Germany .

OTHER PUBLICATIONS

Search Report EP 98 30 0981.

*Primary Examiner*—Michael L. Gellner
*Assistant Examiner*—Briggitte R. Hammond
*Attorney, Agent, or Firm*—Jordan B. Bierman; Bierman, Muserlian and Lucas

[57] ABSTRACT

An electric cable (2) includes a conductor (2*a*) which comprises a plurality of strands (21) and an insulation sheath (2*b*) which covers an outer periphery of the conductor (2*a*). An insulation displacement terminal (5) effects an insulation displacement connection with the conductor (2*a*) with the strands (21) being compressed into a slot width in which a contact resistance is in a stable area and the strands are not cut. The terminal (5) comprises: a slot (5*a*) having a given slot width (WS): a first pair of slopes (5*b*) opposed to each other and formed on an open part of the slot (5*a*) at an upper side with respect to an inserting direction of the electric cable (2), the first pair of slopes (5*b*) being adapted to guide the electric cable (2) into the slot (5*a*); and a second pair of slopes (5*c*) opposed to each other and formed on the open part of the slot (5*a*) at a lower side with respect to the direction of insertion of the electric cable. The second pair of slopes (5*c*) are adapted to compress and rearrange the strands (21) in the electric cable. The slot width (WS), an opening width (WS1) of the first pair of slopes (5*b*), an opening width (WS2) of the second pair of slopes (5*c*), an outer diameter (D) of the insulation sheath (2*b*) in the electric cable (2), and an outer diameter (d) of the conductor (2*a*) in the electric cable (2) are set to satisfy the following relationship:

$$WS1>D>d>WS2>WS; \text{ and } 0.8 \geqq WS2/d \geqq 0.7.$$

4 Claims, 5 Drawing Sheets

INSULATION DISPLACEMENT TERMINAL

BACKGROUND OF THE INVENTION

This invention relates to an insulation displacement terminal which can effect stable insulation displacement connection with a conductor comprising a number of fine strands.

For convenience of explanation, a conventional insulation displacement terminal will be described below by referring to the drawings. FIG. 6A is a perspective view of a conventional insulation displacement terminal.

FIGS. 7A and 7B are graphs which illustrate relationships between a slot width and the number of cutoff strands and between the slot width and a contact resistance, respectively.

Heretofore, in order to connect a conductor in an electric cable, for example, a wire harness for an automotive vehicle or the like to a terminal in a manner of insulation displacement connection, an insulation displacement terminal 1, as shown in FIG. 6A, has been used which is provided with a slot 1*a* having a given slot width WS. The slot 1*a* in the insulation displacement terminal 1 is provided on an open part with a pair of slopes 1 *b* each having a wire (electric cable) guide angle a with respect to a longitudinal axis of the slot or a direction of insertion of the electric cable. Such an insulation displacement terminal requires a maximum force when an insulation sheath in the electric cable is stripped. This maximum force is called a stripping force for an insulation sheath.

In a design of the insulation displacement terminal, after a relationship between the wire guide angle a and the stripping force for insulation sheath has been found, the wire guide angle a is selected so that a force applied to the insulation displacement terminal or an insulation displacement tool becomes minimum. In order to maintain stabilization of insulation displacement connection of the conductor, the slot width SW is set so that the strands of the conductor are compressed without causing any cutoff of the strands, so that the strands behave as if they were a single wire as a whole, and so that the contact resistance between the conductor and the insulation displacement terminal becomes stable. That is, as shown in FIG. 7A, the slot width WS is designed so that no cutoff of the strands is caused and the contact resistance is in an allowable area of stabilization.

On the other hand, an electric cable to be used in movable parts in an apparatus which effects a sliding, rotating, or bending motion requires high flexibility. A conductor having a number of fine strands is suitable for satisfying such a requirement (hereinafter referred to a flexible conductor). Such a flexible conductor has a nominal cross sectional area and a number of strands, such as more than fifteen (15) in 0.3 $mm^2$, more than nineteen (19) in 0.5 $mm^2$, more than thirty (30) in 0.75 $mm^2$, more than thirty-seven (37) in 1.25 $mm^2$, or the like.

However, since the strands of the flexible conductor move irregularly and are not stable as a whole when a load is applied to the conductor, there is a problem in which the contact resistance is not stable, if a inflexible conductor having the same nominal cross sectional area is combined with a flexible conductor in which the contact resistance becomes stable in the slot width WS.

If the slot width WS is set to be narrower in order to make the contact resistance of the flexible conductor stable, a part of the strands are cut at the edges b on the intersections between the slopes 1*b* each having the wire guide angle a and the flat surfaces of the slot 1*a* when the conductor is inserted into the slot 1*a,* and thus the strands are not compressed fully. Consequently, a contact load between the strands or between the strands and the terminal does not become great and ultimately the contact resistance does not remain stable.

Even if the slot width WS is changed to find the stable area of the flexible conductor, as shown in FIG. 7B, the strands move irregularly and become unstable as a whole when the slot width WS is wide, while the stands are cut when the slot width is narrow. Accordingly, there is no slot width WS in which the contact resistance is in the stable area and the insulation displacement connection can not be effected.

SUMMARY OF THE INVENTION

An object of the present invention is to provide an insulation displacement terminal which effects an insulation displacement connection with the conductor with strands being compressed into a slot width in which a contact resistance is in a stable area and the strands are not cut.

In order to achieve the above object, an insulation displacement terminal in accordance with the present invention is adapted to be connected to a conductor in an electric cable in a manner of insulation displacement connection. The electric cable includes the conductor which comprises a plurality of strands and an insulation sheath which covers an outer periphery of the conductor. The insulation displacement terminal comprises: a slot having a given slot width WS; a first pair of slopes opposed to each other and formed on an open part of the slot at an upper side with respect to a direction of insertion of the electric cable, the first pair of slopes being adapted to guide the electric cable into the slot; and a second pair of slopes opposed to each other and formed on the open part of the slot at a lower side with the direction of insertion of the electric cable. The second pair of slopes are adapted to compress and rearrange the strands in the electric cable. The slot width WS, an opening width WS1 of the first pair of slopes, an opening width WS2 of the second pair of slopes, an outer diameter D of the insulation sheath in the electric cable, and an outer diameter d of the conductor in the electric cable are set to satisfy the following relationship:

$$WS1>D>d>WS2>WS;\ \text{and}\ 0.8\geqq WS2/d\geqq 0.7.$$

The inventors of this invention have examined a behavior of the flexible conductor in a process of insulation displacement connection of the flexible conductor into the slot and have created a structure of the insulation displacement terminal which can effect stable insulation displacement connection. This process will be described below by referring to FIG. 6B. FIG. 6B is a perspective view of an apparatus which carried out a compression experiment of the electric cable with the flexible conductor.

As shown in FIG. 6B, an electric cable 2 with a flexible conductor 2*a* is compressed by insertion between two pairs of plates 10*a,* 10*a* and 10*b,* 10*b* which are made like the insulation displacement terminal 1. A distance between them is set to be WS. In accordance with this experiment the inventors have found that a specific slot width WS exists which does not cause any cutoff of the strands of the conductor and maintains the contact resistance in the stable area.

However, in this case, it is necessary to strip the insulation sheath beforehand, and otherwise the insulation displacement connection can not be obtained since conduction can not be made between the conductor and the terminal even if the conductor is compressed.

The inventors have examined how the insulation sheath is stripped in a process of actual insulation displacement connection. In the process, the insulation sheath 2*b* comes into contact with the edges b on the intersections between the slopes 1*b* each having the wire guide angle a and the flat surfaces of the slot 1*a* and the insulation sheath 2*b* is broken at the contact portion by a local great load onto the contact portion. Then, the edges enter the broken portion to widen it. Consequently, the insulation sheath 2*b* is stripped.

Also, the inventors have examined in which step the strands are cut upon insertion of the flexible conductor 2*a* into the slot 1*a* having the narrow slot width WS. When the strands are inserted rapidly into the narrow slot 1*a,* a great force is applied to the strands and the edges so as to rapidly deform the strands. This will cause cutoff of the strands.

In accordance with the above examination, the inventors have come into the following conclusion. It is difficult to strip the insulation sheath 2*b* by means of only the pair of edges b and at the same time to push the strands into the narrow slot 1*a* rapidly. If the insulation displacement terminal has a structure which can divide the process of insulation displacement connection into two steps of stripping the insulation sheath 2*b* and of pushing the strands into the slot 1*a,* it will be possible to carry out insulation displacement connection of the flexible conductor 2*a*.

The insulation displacement terminal of the present invention adopts the structure described above. The edges on the intersections between the first and second pairs of slopes firstly strip the insulation sheath and the second pair of slopes secondly guide the strands of the conductor into the narrow slot while gradually compressing and rearranging the strands in the process of insulation displacement of the terminal in accordance with the present invention.

Preferably, the second slope is formed into a smooth curve which changes a curvature continuously in the slot. It is possible to smoothly push the strands into the narrow slot in the terminal without causing any cutoff of the strands while compressing and rearranging the strands gradually. There is also no possibility of cutoff of the strands on the edges since there is no edge on the intersection between the second slope and the flat surface of the slot.

Preferably, a nominal cross sectional area of the conductor and the number of the strands are set to be more than fifteen (15) in 0.3 $mm^2$, more than nineteen (19) in 0.5 $mm^2$, more than thirty (30) in 0.75 $mm^2$, and more than thirty-seven (37) in 1.25 $mm^2$. However, the present invention is not limited to the nominal cross sectional area of the conductor and the number of the strands mentioned above.

DETAILED DESCRIPTION OF THE PREFERRED EMBODIMENTS

Figure 1B:
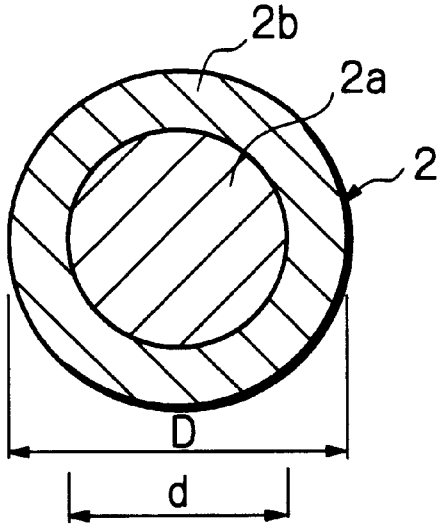
FIG. 1B is a schematic cross sectional view of an electric cable having a flexible conductor, illustrating a dimensional relationship between the electric cable and the terminal shown in FIG. 1A.

Referring now to the drawings, embodiments of an insulation displacement terminal in accordance with the present invention will be explained below. In the embodiments, the same structures and operations as those in the prior art described above are illustrated in FIGS. 1A to 5 by the same signs and reference numbers as those in FIGS. 6A, 6B, 7A and 7B and a detailed explanation of them is omitted.

Figure 5:
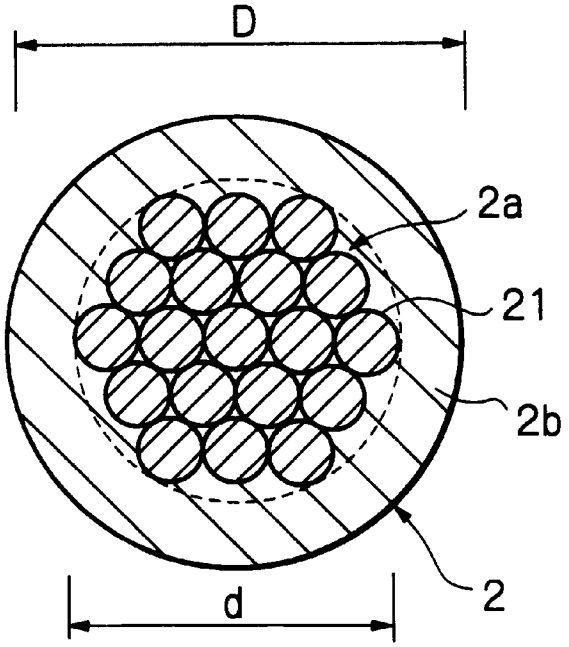
FIG. 5 is a detailed cross sectional view of the electric cable having the flexible conductor, illustrating the figure similar to FIG. 1B.

As shown in FIGS. 1B and 5, an electric cable 2 includes a conductor 2*a* and an insulation sheath 2*b* which covers an outer periphery of the conductor 2*a*. The conductor 2*a* comprises a plurality of flexible and fine strands 21.

The conductor 2*a* comprises the flexible and fine strands 21, which is used in an actual work at present, has a nominal cross sectional area and the number of strands of more than fifteen (15) in 0.3 $mm^2$, more than nineteen (19) in 0.5 $mm^2$, more than thirty (30) in 0.75 $mm^2$, and more than thirty-seven (37) in 1.25 $mm^2$.

It is assumed hereinafter that an outer diameter of the insulation sheath 2*b* in the electric cable 2 is "D" and an outer diameter of the conductor 2*a* in the electric cable 2 is "d". The outer diameter d of the conductor 2*a* is a diameter of the minimum circumcircle which circumscribes the strands 21 disposed on the outermost periphery of the conductor 2*a*.

Figure 1A:
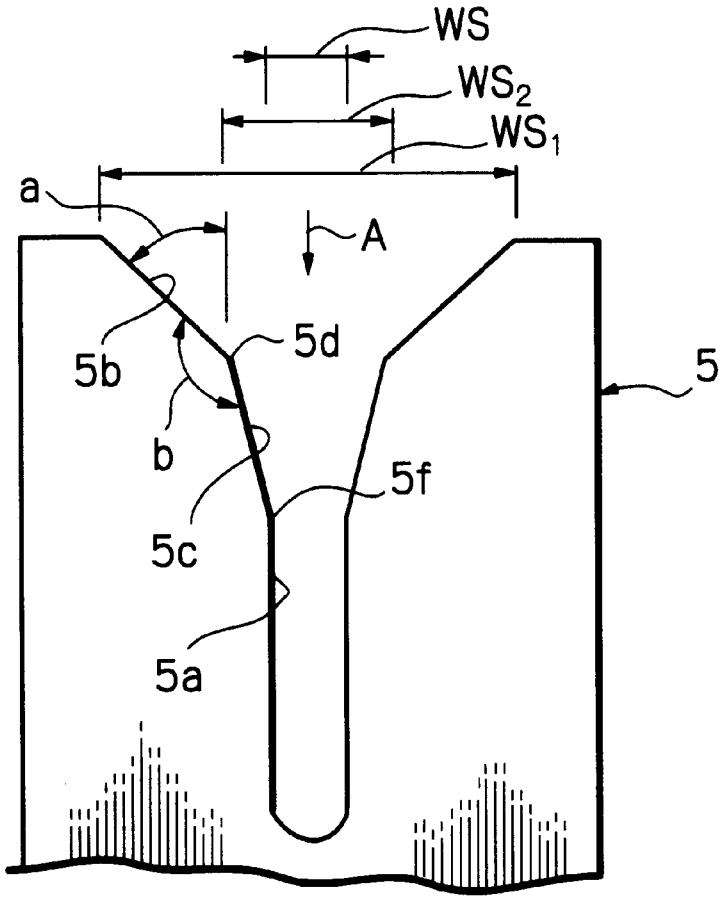
FIG. 1A is a front elevational view of an insulation displacement terminal in accordance with the present invention.

As shown in FIG. 1A, an insulation displacement terminal 5 is provided with a slot 5*a* having a given slot width WS in which a contact resistance of the strand 21 of the conductor 2*a* is in a stable area. The slot 5*a* is provided on the open part at an upper side and a lower side with respect to a direction of insertion A of the electric cable 2 with a first pair of slopes 5*b* for guiding the electric cable 2 and with a second pair of slopes 5*c* for compressing and rearranging the strands 21 in the electric cable 2, respectively. The first and second pairs of slopes 5*b* and 5*c* are opposed to each other in the slot 5*a*, respectively. It is assumed hereinafter that an opening width of the first pair of slopes 5*b* is "WS1" and an opening width of the second pair of slopes 5*c* "WS2".

In a process for making an insulation displacement connection between the insulation displacement terminal 5 and the conductor 2*a* in the electric cable 2, firstly, the electric cable 2 is guided into the slot 5*a* by the first pair of slopes 5*b* and the insulation sheath 2*a* is stripped by a pair of edges 5*d* on intersections between the first pair of slopes 5*b* and the second pair of slopes 5*c* (corresponding to the opening width WS2 of the second pair of slopes 5*c*).

Secondly, the strands 21 of the conductor 2*a* are gradually compressed and rearranged by the second pair of slopes 5*c* and then the strands 21 are pushed into the slot 5*a* having the narrow slot width WS as they are.

Thus, the conductor 2*a* can be pushed into the narrow slot 5*a* without causing any cutoff of the strands 21 of the conductor 2*a*. Also, the second pair of slopes 5*c* and slot 5*a* can fully compress the conductor 2*a* into the slot width WS in which the contact resistance is in the stable area.

In order to guide the electric cable 2 between the first pair of slopes 5*b,* it is necessary that the opening width WS1 of the first pair of slopes 5*b* is greater than the outer diameter D of the insulation sheath 2*b* in the electric cable 2, that is, WS1>D. Also, in order to strip the insulation sheath 2*b* in the electric cable 2 by the pair of edges 5*d* on the intersections between the first pair of slopes 5*b* and the second pair of slopes 5*c,* it is necessary that the opening width WS2 of the second pair of slopes 5*c* is smaller than the outer diameter D of the insulation sheath 2*b* in the electric cable 2, that is, WS2<D.

Further, since the edges 5*d* must reach the outermost periphery of the conductor 2*a* in order to completely strip the insulation sheath 2*b* after the insulation sheath 2*b* comes into contact with the edges 5*d,* it is necessary that the outer diameter d of the conductor 2*a* is greater than the opening width WS2 of the second pair of slopes 5*c,* that is, d>WS. Accordingly, in order to strip the insulation sheath 2*b* without causing any cutoff of strands 21 of the conductor 2*a,* it is necessary to satisfy the following relationship: WS1>D>d>WS2>WS.

Figure 6A:
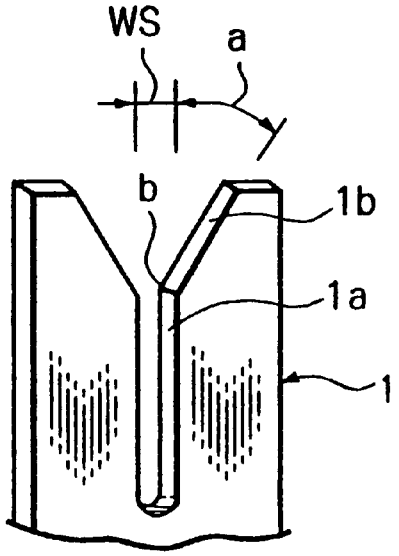
Fig. 6A PRIOR ART
FIG. 6A is a perspective view of a conventional insulation displacement terminal.
Figure 6B:
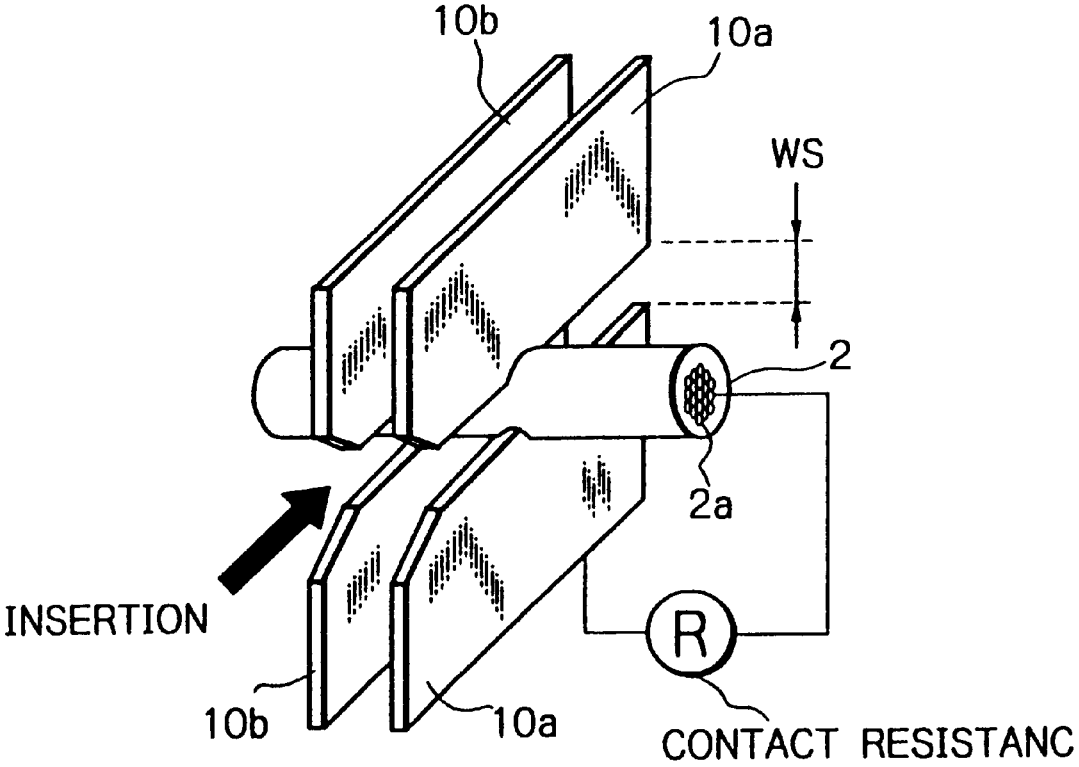
FIG. 6B is a perspective view of an apparatus which is subject to a compression test of the electric cable with the flexible conductor.
Figure 7A:
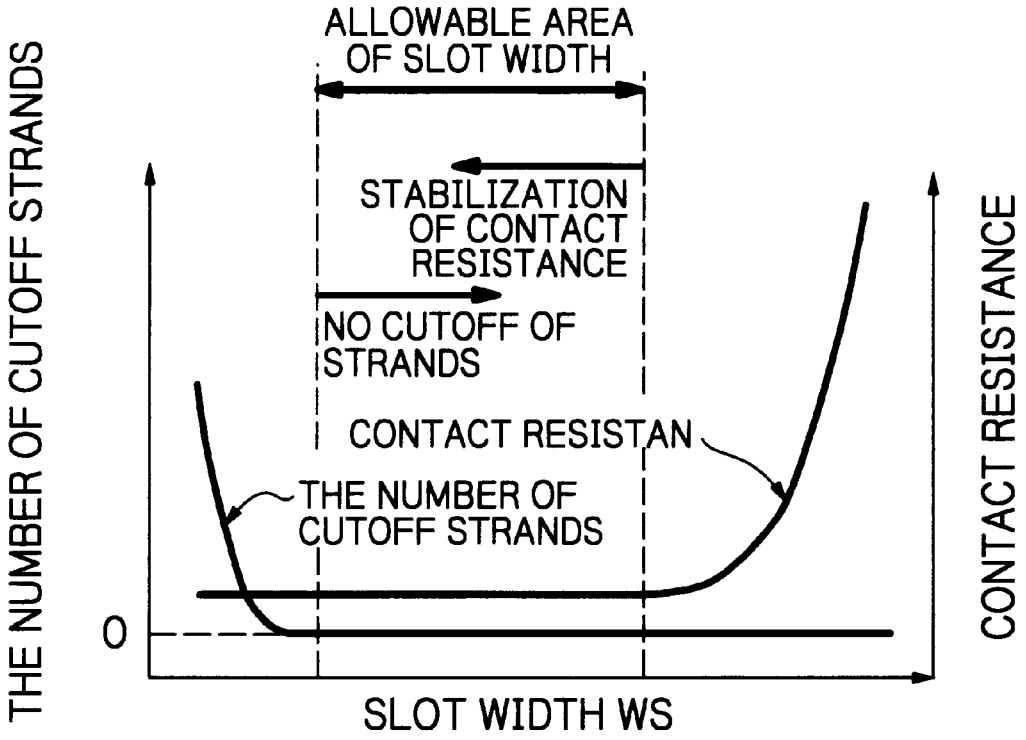
FIGS. 7A and 7B are graphs which illustrate relationships between a slot width and the number of cutoff strands and between the slot width and a contact resistance, respectively.
Figure 7B:
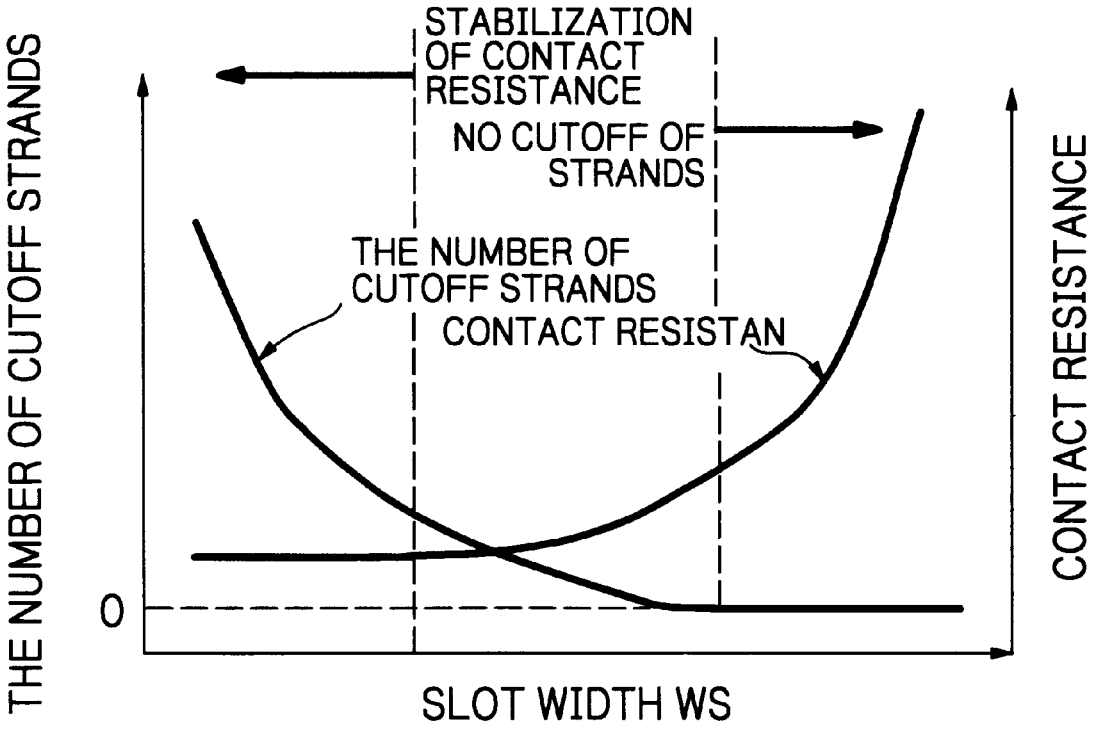

The slot width WS is determined by making various terminals each having the WS which satisfies the above-mentioned relationship among the WS1, WS2, D, and d and then by their connection characteristics; or by using the simple method shown in FIG. 6B and then by observing a behavior in which the contact resistance is in the stable area without causing any cutoff of the strands 21 of the conductor 2*a.*

Also, a wire guide angle "a" for a wire (electric cable) defined by the first slope 5*b* with respect to the direction of insertion A is determined by the conventional method or by surely bringing the edge 5*d* on the intersection between the first slope 5*b* and the second slope 5*c* into contact with the insulation sheath 2*b* in the electric cable 2.

In addition, an angle b defined between the first slope 5*b* and the second slope 5*c* is preferably set so that the intersection forms the edge 5*d* correctly, for example, to be less than 160°.

On the other hand, the inventors have verified by experiment a relationship between the outer diameter d of the conductor 2*a* to be connected into the slot 5*a* in the insulation displacement terminal 5 and the opening width WS2 of the second pair of slopes 5*c.* Consequently, it has been found that the contact resistance can compress the strands into the stable area without causing any cutoff of the strands when the relationship between the opening width WS2 of the second pair of slopes 5*c* and the outer diameter d of the conductor 2*a* satisfies the following condition.

That is, the relationship between the outer diameter d of the conductor 2*a* and the opening width WS2 must satisfy the condition: $0.8 \geqq WS2/d \geqq 0.7$. If WS2/d is greater than 0.8 (WS2/d>0.8), separation (cutting) of the insulation sheath 2*b* in the electric cable 2 becomes poor and the strands 21 of the conductor 2*a* hardly come into contact with the slot 5. If WS2/d is smaller than 0.7(WS2/d<0.7), cutoff of the strands is apt to cause.

It is necessary from the foregoing to set $0.8 \geqq WS2/d \geqq 0.7$ in addition to WS1>D>d>WS2>WS described above.

Figure 2:
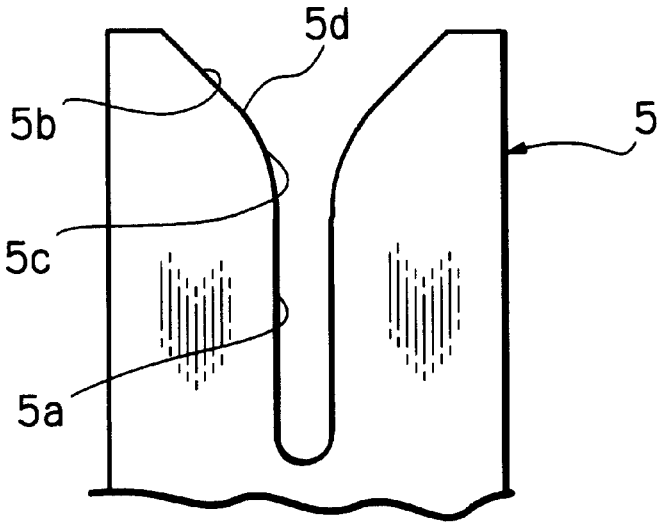
FIG. 2 is a front elevational view of an alteration of the insulation displacement terminal shown in FIG. 1A.

Since there is no need to specify an edge 5*f* on an intersection between the second slope 5*c* of the insulation displacement terminal 5 and a flat surface of the slot 5*a*, it is possible to form the second pair of slopes 5*c* into a smooth curve which changes a curvature continuously to the slot 5*a,* as shown in FIG. 2. This structure will preclude the possibility of cutoff of the strands on the edges 5*f.*

Figure 3A:
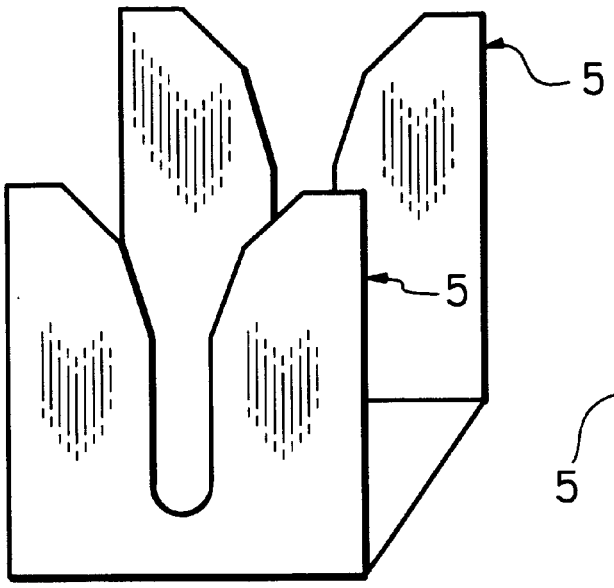
FIGS. 3A and 3B are perspective views of another alterations of the insulation displacement terminal shown in FIG. 1A.
Figure 3B:
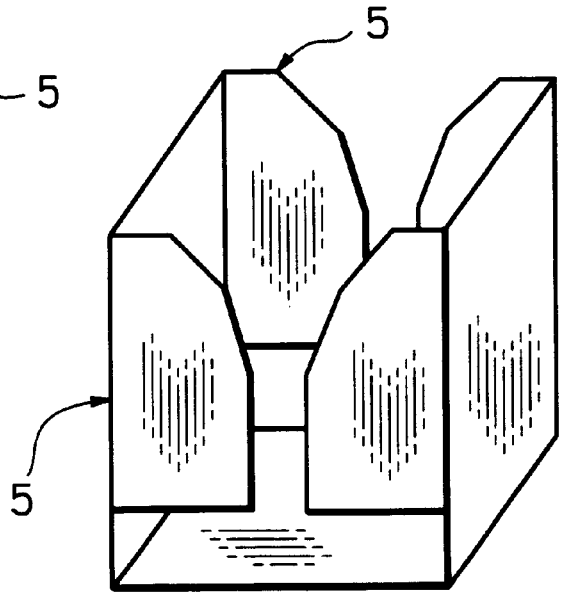
Figure 4:
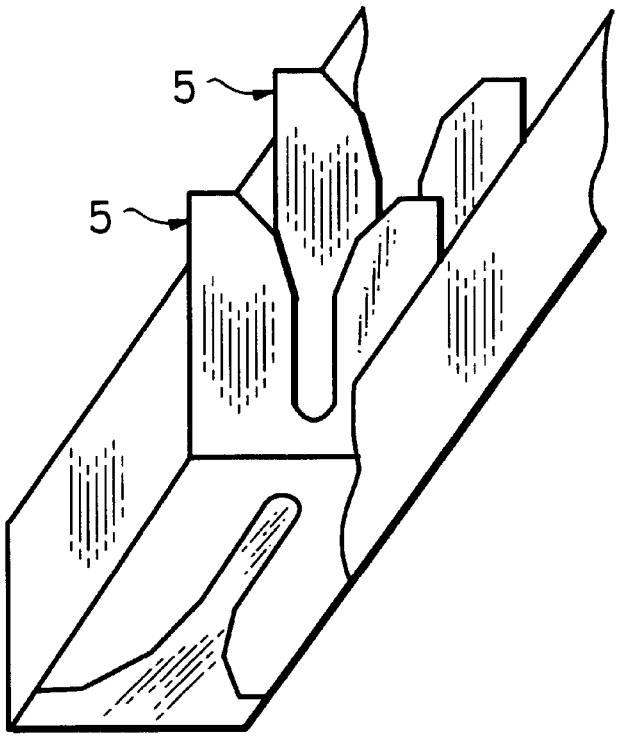
FIG. 4 is a perspective view of still another alteration of the insulation displacement terminal shown in FIG. 1A.

The insulation displacement terminal 5 may be altered to various kinds of configuration such as a configuration in which a pair of insulation displacement terminal 5, 5 stand on the ends of the bottom wall in parallel to each other, as shown in FIG. 3A, a configuration in which a pair of insulation displacement terminals 5,5 are provided on side walls, as shown in FIG. 3B, or a configuration in which a pair of insulation displacement terminals 5,5 are punched up from a bottom wall of a U-shaped member, as shown in FIG. 4.

It will be apparent from the foregoing that it is possible to push the strands into the narrow slot in the terminal without causing any cutoff of the strands, to fully compress the strands into the slot width in which the contact resistance is in the stable area, and to enable low costs and a compact size to be obtained by employing the insulation displacement connection for the flexible conductor, since the edges on the intersections between the first and second pairs of slopes firstly strip the insulation sheath and the second pair of slopes, secondly guide the strands of the conductor into the narrow slot while gradually compressing and rearranging the strands in the process of insulation displacement of the terminal in accordance with the present invention.

In the case where the second pair of slopes are smooth curves which changes the curvature continuously, the conductor can be readily inserted into the narrow slot and there is no possibility of cutoff of the strands on the edges since there is no edge on the intersection between the second slope and the flat surface of the slot.

The entire disclosure of Japanese Patent Application No. 9-29383 filed on Feb. 13th, 1997 including specification, claims, drawings and summary is incorporated herein by reference in its entirety.

What is claimed is:

1. An insulation displacement terminal adapted to be connected to a conductor in an electric cable in a manner of insulation displacement connection, said electric cable including said conductor which comprises a plurality of strands and an insulation sheath which covers an outer periphery of said conductor, comprising:

a slot having a given slot width WS:

a first pair of slopes opposed to each other and formed on an open part of said slot at an upper side with respect to a direction of insertion of said electric cable, said first pair of slopes being adapted to guide said electric cable into said slot; and a second pair of slopes opposed to each other and formed on said open part of said slot at a lower side with respect to said direction of insertion of said electric cable, said second pair of slopes being adapted to compress and rearrange said strands in said electric cable;

wherein said slot width WS, and opening width WS1 of said first pair of slopes, an opening width WS2 of said second pair of slopes, an outer diameter D of said insulation sheath in said electric cable, and an outer diameter d of said conductor in said electric cable are set to satisfy the following relationship: WS1>D>d>WS2>WS; and $0.8 \geqq WS2/d \geqq 0.7$.

2. The insulation displacement terminal according to claim 1, wherein a nominal cross sectional area of said conductor and the number of said strands are set to be more than fifteen (15) in 0.3 $mm^2$, more than nineteen (19) in 0.5 $mm^2$, more than thirty (30) in 0.75 $mm^2$, and more than thirty-seven (37) in 1.25 $mm^2$.

3. The insulation displacement terminal according to claim 1, wherein said second slope is formed into a smooth curve which changes a curvature continuously in said slot.

4. The insulation displacement terminal according to claim 3, wherein a nominal cross sectional area of said conductor and the number of said strands are set to be more than fifteen (15) in 0.3 $mm^2$, more than nineteen (19) in 0.5 $mm^2$, more than thirty (30) in 0.75 $mm^2$, and more than thirty-seven (37) in 1.25 $mm^2$.

* * * * *